US005845341A

United States Patent [19]

Barthold et al.

[11] Patent Number: 5,845,341

[45] Date of Patent: Dec. 8, 1998

[54] COMBINATION HEAD AND EYE-PROTECTIVE APPARATUS AND GOGGLES

[75] Inventors: Michael J. Barthold, Flemington; Louis Orotelli, Washington Twp., both of N.J.

[73] Assignee: Cairns & Brother Inc., Clifton, N.J.

[21] Appl. No.: 872,433

[22] Filed: Jun. 10, 1997

[51] Int. Cl.[6] ..... A42B 3/18

[52] U.S. Cl. ..... 2/424; 2/421; 2/10; 2/452

[58] Field of Search ..... 2/410, 5, 416, 2/422, 424, 10, 426, 452, 9, 173, 421

[56] References Cited

U.S. PATENT DOCUMENTS

| | | | |
|---|---|---|---|
| 3,373,444 | 3/1968 | Militello | 2/424 |
| 3,703,750 | 11/1972 | Irwin, Jr. | 2/10 |
| 3,808,604 | 5/1974 | Rose | 2/5 |
| 4,030,140 | 6/1977 | Burt | 2/410 |
| 4,193,133 | 3/1980 | Laibach et al. | 2/10 |
| 4,276,657 | 7/1981 | Montesi | 2/422 |
| 4,796,308 | 1/1989 | Bourgeois | 2/452 |
| 5,291,880 | 3/1994 | Almovist et al. | 2/5 |
| 5,517,691 | 5/1996 | Blake | 2/5 |
| 5,555,569 | 9/1996 | Lane | 2/5 |
| 5,697,099 | 12/1997 | Siska, Jr. et al. | 2/5 |

*Primary Examiner*—Michael A. Neas
*Attorney, Agent, or Firm*—R. Gale Rhodes, Jr.

[57] ABSTRACT

Combination head and eye protective apparatus including a head-protective helmet having a nape device for fitting the helmet to the head of a wearer of the helmet, and goggles including a mounting member for mounting the goggles to the nape device. Goggles including a goggle frame, eye protective lens mounted in the frame, and mounting member for mounting the goggles to the nape device of a head-protective helmet.

29 Claims, 3 Drawing Sheets

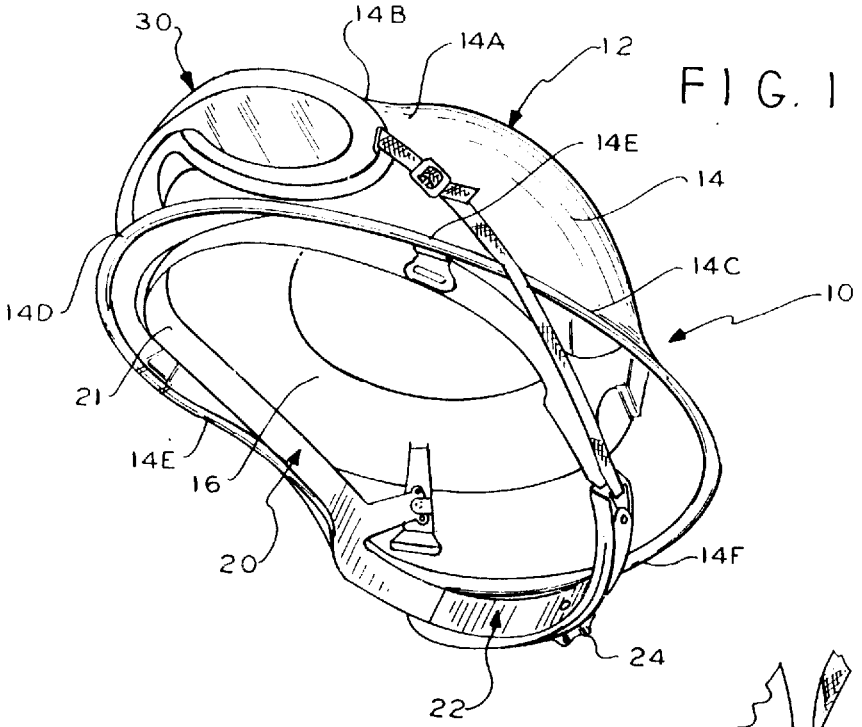
FIG. 1
FIG. 2
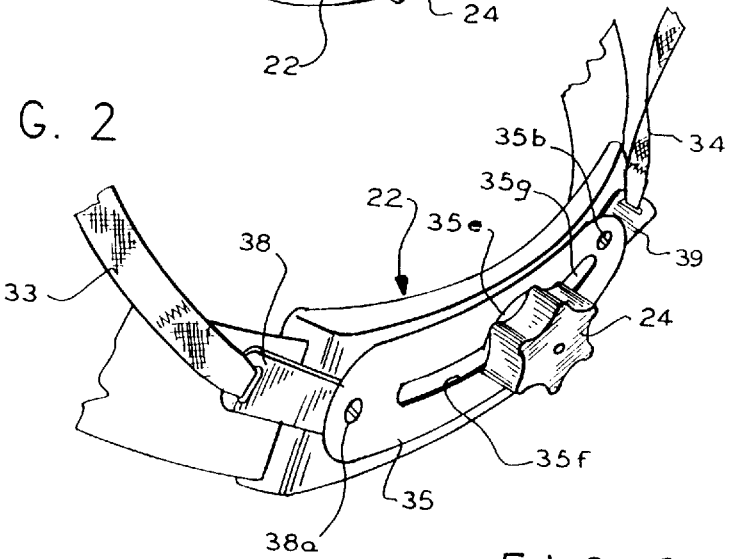
FIG. 3
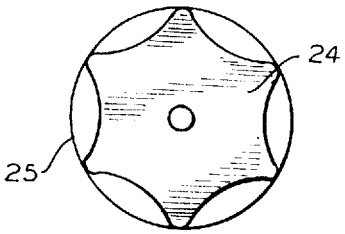

COMBINATION HEAD AND EYE-PROTECTIVE APPARATUS AND GOGGLES

BACKGROUND OF THE INVENTION

This invention relates generally to new and improved combination head and eye protective apparatus and more particularly relates to a new and improved combination head-protection helmet, such as, for example, a firefighter's helmet, an industrial helmet, a head-protective helmet sometimes referred to in the art as a hard hat, and the like, and goggles. Further generally, this invention relates to new and improved goggles and more particularly relates to new and improved goggles particularly useful for being mounted to a head-protective helmet of the types noted above.

In February 1997, the National Fire Protection Association (NFPA) approved the use of goggles by firefighters in lieu of a face shield or visor.

Accordingly, there exists a specific need in the art for combination firefighter's helmet and goggles mounted thereto, and there further exists a specific need in the art for goggles particularly useful for being mounted to a firefighter's helmet and other head-protective helmets of the types noted above.

Combination firefighter's helmet and goggles and goggles for being mounted to a firefighter's helmet are known to the prior art. For example, such combination and goggles are disclosed in U.S. Pat. No. 5,341,516 entitled GOGGLE SUPPORT SYSTEM, patented Aug. 30, 1994, Eric Keim inventor. In the second embodiment disclosed in this patent and shown in FIGS. 3–6, goggles 15 are mounted to a helmet 19 by thumb screws 79. Referring to FIGS. 5 and 6, particularly FIG. 5, the thumb screw 79 extending from the thumb wheel 77 extends through a grommet 89 provided in the main goggle strap 41 and is threaded into a nut 85. Such mounting of the goggles 15 to the helmet 19 by the use of thumb screws 79 is tedious, requires considerable manual dexterity and makes it undesirably difficult to remove and replace the goggles. Accordingly, there exists a need in the art for goggles which may be quickly and easily mounted to a head-protective helmet such as a firefighter's helmet and which goggles may be quickly and easily removed and replaced.

Further, it will be noted that since the goggles 15 are mounted directly to the outer hard helmet 19 disclosed in U.S. Pat. No. 5,341,516, upon the helmet 19 being inadvertently lost or knocked off during fire fighting, the firefighter loses not only his head protection but also loses eye protection, since the goggles will be lost from the firefighter's face upon the helmet being inadvertently removed. Accordingly, there exists a specific need in the art for combination firefighter's helmet and goggles wherein upon the outer hard helmet or shell being inadvertently lost or removed in the process of fighting a fire, the goggles remain covering the firefighter's eyes and providing eye protection.

SUMMARY OF THE INVENTION

It is the object of the present invention to satisfy the foregoing needs in the art.

Combination head and eye protective apparatus satisfying such needs and embodying the present invention may include a head-protective helmet including a nape device for fitting the helmet to the head of a wearer of the helmet, and goggles including a mounting member for mounting the goggles to such nape device.

Goggles satisfying such needs and embodying the present invention may include a goggle frame, eye protective lens mounted in the frame, and a mounting member for mounting the goggles to the nape device of a head-protective helmet.

DESCRIPTION OF THE DRAWINGS

FIG. 1 is a perspective view of a firefighter's helmet and goggles embodying the combination head and eye protective apparatus of the present invention;

FIG. 2 is a partial perspective view of the rearward portions of the goggles and nape device shown in FIG. 1;

FIG. 3 is a front elevational view of a rotatable ratchet knob included in the nape device of the head-protective helmet in one embodiment of the present invention;

DESCRIPTION OF THE PREFERRED EMBODIMENTS

Figure 4:
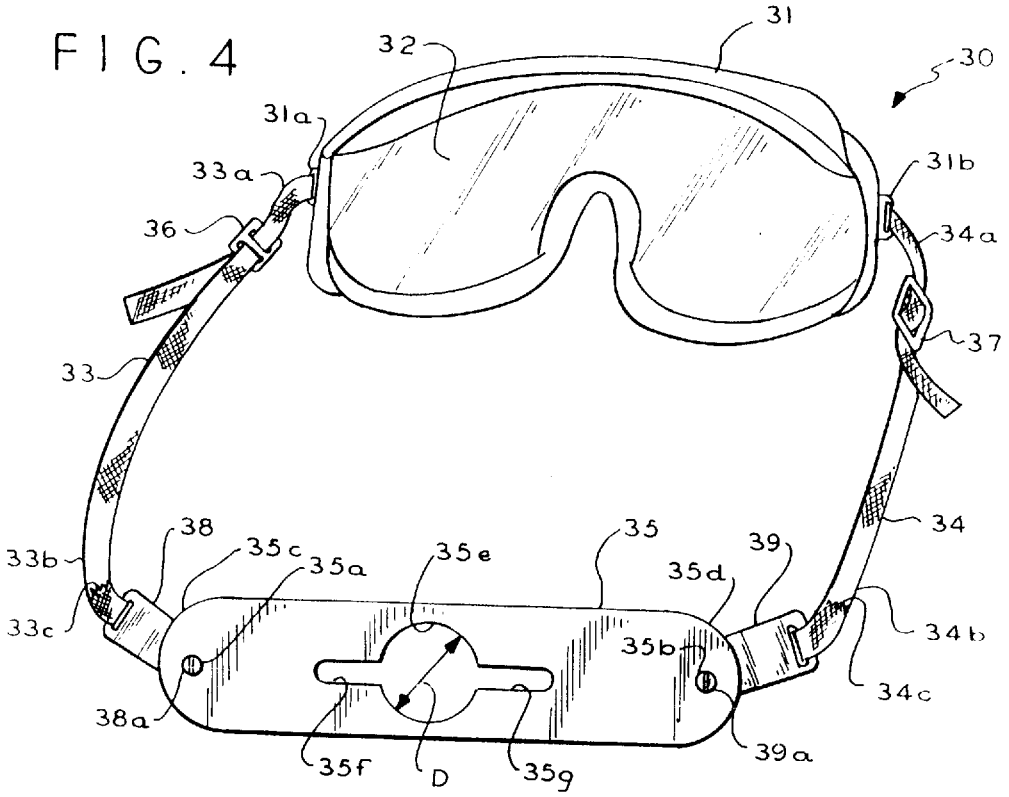
FIGS. 4, 5 and 6 are, respectively, perspective views of various embodiments of goggles of the present invention, particularly useful in the combination head and eye protective apparatus of the present invention, FIG. 5 being a partial view.

Combination head and eye-protective apparatus embodying the present invention is shown in FIGS. 1 and 2 and indicated in FIG. 1 by general numerical designation 10. In the preferred embodiment, the head-protective apparatus of this combination may be embodied as a firefighter's helmet indicated by general numerical designation 12 in FIG. 1; however, it will be understood that such firefighter's helmet is merely by way of illustration, and the present invention is not limited to such firefighter's helmet. Firefighter's helmet 12 may include a hard outer shell 14, an inner impact cap 16 mounted suitably removably to the hard outer shell 14 in the manner known to the art. For example, the hard outer shell 14 and inner impact cap 16 may be generally of the type disclosed in U.S. Pat. No. 4,286,339 entitled FIREMAN'S HELMET WITH ENERGY ABSORBING LINER, issued Sep. 1, 1991, Peter A. Coombs inventor; this patent is incorporated herein by reference as if fully reproduced herein. In this '339 patent, the foam liner 20, sometimes referred to in the art as an inner impact cap, is made of a non-resilient foam material, such as polyurethane, and is mounted removably to the hard outer shell 10 as disclosed at Column 2, lines 27–46 of the '339 patent. Alternatively, the outer hard shell 14 and inner impact cap 16 of FIG. 1 may be generally of the type disclosed in U.S. Pat. No. 5,044,016, entitled PROTECTIVE HELMET ASSEMBLY including releasable head retaining assembly, patented Sep. 3, 1991, Christopher E. Coombs inventor; this patent is hereby incorporated herein by reference as if fully reproduced herein. In this patent, the foam liner 26, also referred to in the art as an inner impact cap, is mounted removably to the hard outer shell 12 in the manner disclosed and shown in this patent. As is further disclosed in this '016 patent, the outer shell has an interior, the inner impact cap is mounted removably to the interior of the outer shell, the inner impact cap has an interior, and a cradle of head or web straps 28 for engaging the head of a wearer of the helmet is mounted to the inner impact cap or foam liner 26 and extends inwardly into the interior of the inner impact cap. Further, as taught in the '016 patent at column 4, lines 32–46, the inner impact cap or foam liner 26 is removable from the outer shell 12 upon the outer shell 12 becoming lodged and the firefighter's head loads on the inner liner assembly 14 such as by hanging from the chin strap 22 the inner liner assembly 14 including the inner impact cap foam liner 26 is released from the outer shell 12. This removability of the inner impact cap from the outer shell prevents the fireman from being hanged by his chin strap should the outer shell become lodged, for example, on a floor having a hole through which the fireman falls.

The outer shell 14, FIG. 1, includes a crown 14A having a forward portion 14B and a brim 14*c* circumscribing the crown and extending generally downwardly and outwardly therefrom and including a forward portion 14D, side portions 14E, and a rearward portion 14F.

In the preferred embodiment of the present invention, a head band of the type known to the art is included and indicated by general numerical designation 20 in FIG. 1. Head band 20 includes a forward portion 21 mounted suitably to the interior of the inner impact cap 16 and a rearward portion or nape device indicated by general numerical designation 22 mounted suitably pivotally to the forward head band portion 21 and which nape device 22 includes a rotatable ratchet knob 24 for being rotated, in the manner known to the art, to vary the size of the head band 20 to fit the head band to the head of a wearer of the helmet 12. The rotatable ratchet knob 24 is shown in greater detail in FIG. 3 and insofar as is particularly pertinent to the present invention, it will be understood that the rotatable knob 24 includes an effective outer diameter indicated or defined by the circle 25. The significance of the effective outer diameter 25 is addressed in detail below.

Figure 5:
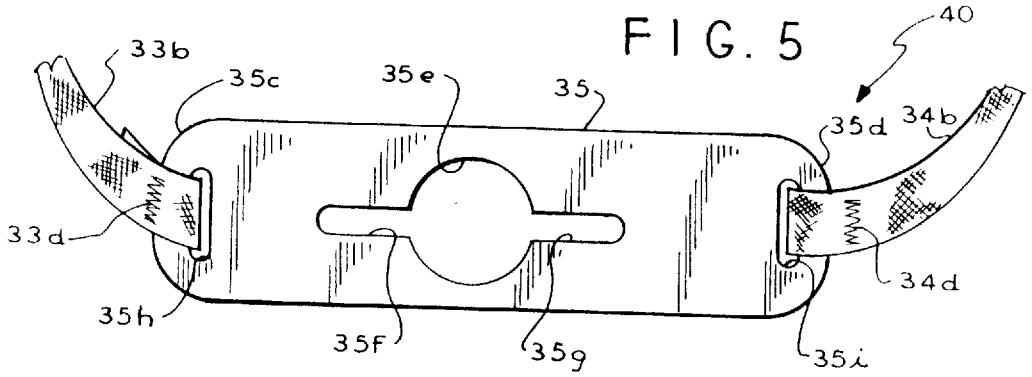
Figure 6:
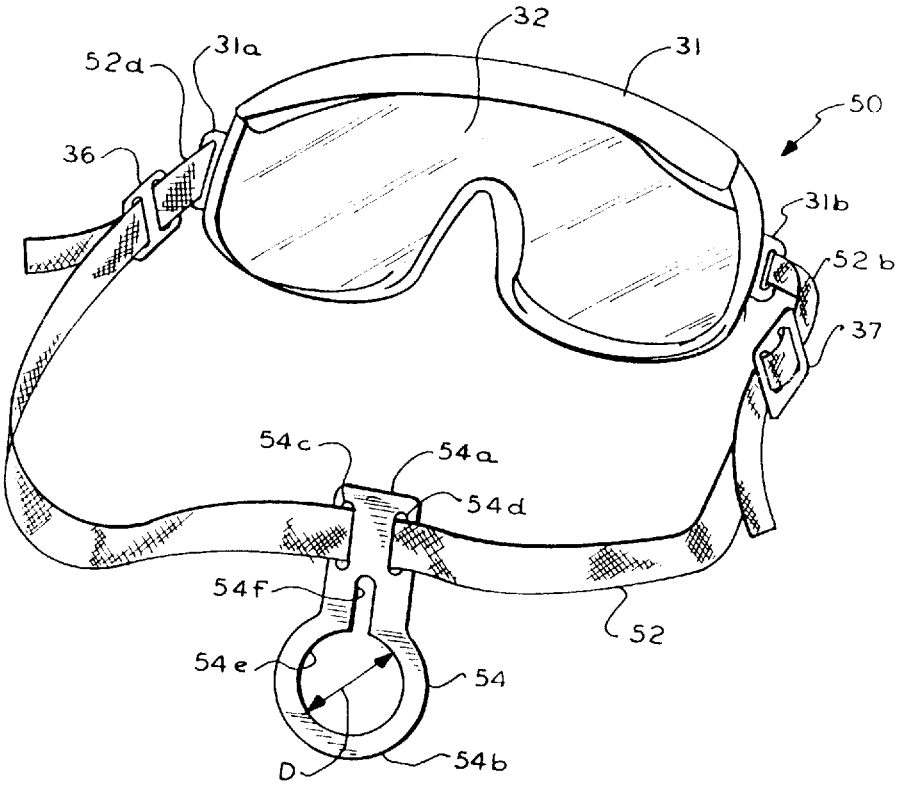

Referring to FIGS. 1, 4, 5, and 6, the eye protective apparatus of the combination head and eye protective apparatus of the present invention may be, by way of example, the goggles embodying the present invention and indicated by general numerical designation 30 in FIGS. 1 and 4, the goggles embodying the present invention and indicated by general numerical designation 40 in FIG. 5, or the goggles embodying the present invention and indicated by general numerical designation 50 in FIG. 6. For illustration, the combination of the present invention illustrated in FIG. 1 includes the goggles 30 of FIG. 4. It will be generally understood that the goggles of the present invention are mounted generally to the helmet 12 and, particularly in the preferred embodiment, are mounted to the nape device 22 of the head band 20 which as noted above is suitably mounted to the inner impact cap which mounts the goggles 30 to the inner impact cap 16 through the head band to the outer shell 14 upon the inner impact cap 16 being mounted to the outer shell as noted above. It will be further generally understood that since the goggles 30 are mounted to the inner impact cap 16, upon the outer shell 14 being inadvertently removed, such as by being knocked off inadvertently in the process of fighting a fire, the inner impact cap 16 will remain mounted to the firefighter's head by the straps, as noted above in reference to the '016 patent, and since the goggles are mounted to the inner impact cap, the firefighter will not lose eye protection even though the head protection provided by the outer shell 14 has been lost.

Figure 4A:
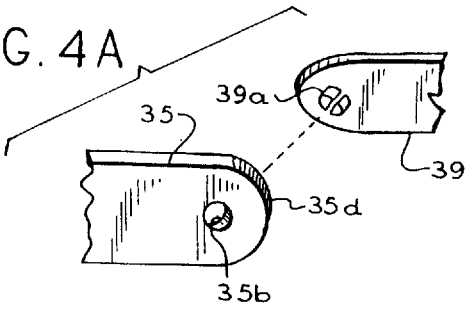
FIG. 4A is an exploded view of a portion of FIG. 4.

Referring in particular to goggle embodiment 30 shown in FIG. 4, in this embodiment the goggles 30 may include a goggle frame 31, substantially transparent eye protective lens 32 mounted in the frame, a pair of elastic bands or straps 33 and 34 and a mounting member 35 for mounting the goggles 30 to the nape device 22 shown in FIG. 1. The elastic strap 33 includes a first end 33*a*, a second end 33*b* and the elastic strap 34 includes a first end 34*a* and a second end 34*b*. The goggle frame 31 includes opposed outer projections or portions 31*a* and 31*b* provided with openings, as shown, through which the first ends 33*a* and 34*a* of the respective elastic straps 33 and 34 are looped and then threaded back through suitable slide buckles 37 and 38 to mount the elastic strap ends 33*a* and 34*a* to the goggle frame 31. The slide buckles 36 and 37 may be used, in the manner known to the art, to initially vary the overall length of the elastic straps 33 an 34 before the elasticity of the straps performs its function as described herein. If desired, the ends of the elastic straps and the elastic straps may be provided with suitable hook and loop patches to fasten down the loose ends of the elastic straps. In this embodiment, the ends 33*b* and 34*b* of the respective elastic straps 33 and 34 are mounted to the mounting member 35, in particular mounted pivotally to the mounting member 35, by suitable tabs 38 and 39. The tabs 38 and 39 are provided with an opening as shown through which the respective ends 33*b* and 34*b* of the elastic straps 33 and 34 are looped after which the strap ends are doubled back and sewn upon themselves as indicated by the sewing lines 33*c* and 34*c*. The tabs 38 and 39 are provided with suitable split button snaps 38*a* and 39*a* which are respectively snap fitted, in the manner known to the art, into openings 35*a* and 35*b* extending through opposed outer end portions 35*c* and 35*d* of the mounting member 35. As shown in detail in FIG. 4A with regard to representative tab 39 and the rightward end portion 35*d* of the mounting member 35, the split button snap 39*a* is snap fitted into the mounting member opening 35*b* to mount the tab 39, and thereby the elastic strap end 34*b*, FIG. 4, pivotally to the mounting member 35.

Referring again to FIG. 4, the mounting member 35 in the preferred embodiment extends generally longitudinally and is made of a suitable flexible material and is provided with a generally circular opening 35*e* for having the rotatable ratchet knob 24, FIGS. 1–3, inserted therethrough to mount the mounting member 35 to the nape device 22, FIGS. 1 and 2, particularly FIG. 2, thereby to mount the goggles 30 to the nape device 22 of the head band 20 and thereby to the inner impact cap 16. For positive mounting, the diameter D, FIG. 4, of the mounting member opening 35*e* is slightly smaller than the effective diameter 25 (FIG. 3) of the rotatable ratchet knob 24. The mounting member 35, FIG. 4, may be provided with one or more slots 35*f* and 35*g* opening into the opening 35*e* to enhance the flexibility of the mounting member 35 to facilitate insertion of the rotatable ratchet knob 24 through the opening 35*e*. It will be noted from FIG. 2 that the nape device 22 has a curvature which curves outwardly, and it will be further understood in accordance with the teachings of the present invention that the mounting member 35 is sufficiently flexible to conform to the curvature of the nape device as generally shown in FIG. 2.

Goggles 40 of the present invention, FIG. 5, are the same as goggles 30 except that the tabs 38 and 39, FIG. 4, are not included and the respective strap ends 33*b* and 34*b* are mounted directly to the opposed outer end portions 35*c* and 35*d* of the mounting member 35. In this embodiment, the opposed outer portions 35*c* and 35*d* of the mounting member are provided with openings 35*h* and 35*i* through which the respective elastic strap ends 33*b* and 34*b* are looped and then doubled back and sewn upon themselves as indicated by the sewing lines 33*d* and 34*d*. Goggles 40 are mounted, particularly removably, to the nape device 22, FIGS. 1 and 2, in the same manner as goggles 30 as described above.

Goggle embodiment 50 of the present invention, FIG. 6, includes the goggle frame 31, eye protective lens 32 shown in FIG. 4 and described above; however, in this embodiment, a single elastic band or strap 52 and an alternative embodiment mounting member 54 are included. Elastic strap 52 includes strap ends 52*a* and 52*b* mounted respectively to the opposed frame projections or outer frame end portions 31*a* and 31*b* in the same manner as the elastic strap ends 33*a* and 34*a* shown in FIG. 4 and described above. The slide buckles 36 and 37 also may be provided on the elastic strap 52 to vary its overall length. In this preferred embodiment, the mounting member 54 extends generally vertically and includes a generally longitudinally extending upper portion 54*a* and a generally circular lower portion 54*b*. Upper portion 54*a*, in the preferred embodiment, is provided with a pair of parallel openings 54*c* and 54*d* through which the central portion of the elastic strap 52 extends to connect or mount the elastic band 52 to the mounting member 54, or as may be viewed alternatively to mount the mounting member 54 to the central portion of the elastic band 52. Mounting member 54 is provided with an opening 54*e* through which the rotatable ratchet knob 24, FIGS. 1–3, is inserted to mount the goggles 50 to the nape device 22, FIGS. 1 and 2, and to thereby mount the goggles to the inner impact cap 16 of FIG. 1. The mounting member or opening 50*e* has a diameter D slightly smaller than the effective diameter 25 of the rotatable ratchet knob 24, FIG. 3, to provide positive connection between the mounting member 54 and the rotatable ratchet knob 24. The mounting member 54 may be made of a suitable flexible material and may be provided with a slot 54*f* opening into the opening 54*e* to enhance the flexibility of the mounting member 54 to facilitate insertion of the rotatable ratchet knob 24 through the opening 54*e*.

It will be understood that the term elastic as used herein, and in the appended claims, with regard to the bands or straps included in the various goggle embodiments of the present invention, is used to denote that such bands and straps are sufficiently stretchable to permit the goggles to be passed over the side and forward brim portions of the helmet to place the goggles in the donned position over the eyes of a wearer of the helmet and in a stowed position on the forward crown portion of the helmet and are sufficiently contractible to maintain the goggles in sealing engagement around the eyes of a wearer of the helmet in the donned position and to maintain the goggles in the stowed position on the forward portion of the helmet crown.

Figure 7:
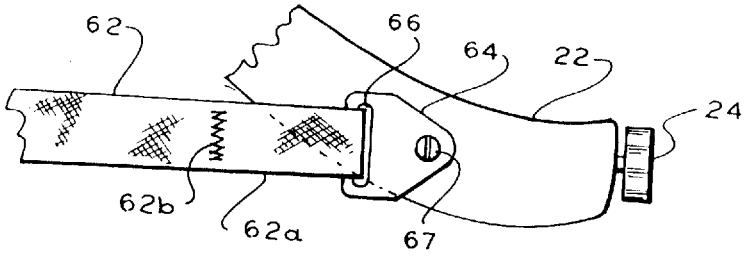
FIG. 7 is a partial view of a further embodiment of combination head and eye protective apparatus of the present invention.

A further alternate embodiment of combination head and eye protective apparatus of the present invention is partially shown in FIG. 7. It will be understood that in this embodiment the helmet 12 of FIGS. 1 and 2 is included, particularly including the nape device 22 partially shown in FIG. 7. Goggles are included and it will be understood that such goggles may include the goggle frame 31 and eye protective lens 32 shown in FIG. 4 and described above and may also include a pair of elastic bands or straps with only a portion of the left plastic strap 62 being shown in FIG. 7. In this embodiment, the first ends of the elastic straps, not shown, are mounted to the goggle frame in the same manner as the first elastic strap ends 33*a* and 34*a* are mounted to the goggle frame 31 in FIG. 4 and described above, but that the second end of the elastic straps (note representative second end 62*a* of representative elastic strap 62) are mounted directly pivotally to the nape device 22 by a suitable tab 64. The tab 64 includes an opening 60 through which the elastic strap end 62*a* is looped and doubled back and sewn upon itself as indicated by the sewing line 62*b*. The tab 64 may be mounted pivotally to the nape device 22 by a suitable connecting pin of the type known to the art, not shown, but extending through both the mounting grommet 64 and the nape device 22 or by a suitable split button snap, of the type described above, provided on the nape device 22. Such pivotal mounting of the elastic straps facilitates pivoting of the goggles with respect to the nape device to facilitate the placement of the goggles in the donned position over the eyes of the wearer and in the stowed position on the helmet as described above with regard to the donned and stowed positions of goggles 30.

The goggle frame 31 and eye protective lens 32, FIGS. 1 and 6, may be, for example, the 450 rubber goggles available from the H. L. Bouton Company, Inc. of Buzzards Bay, Mass. 02532. The elastic straps 33 and 34 of FIG. 4, the elastic straps 33*b* and 34*b* of FIG. 5, the elastic strap 52 of FIG. 6 and the elastic strap 62 of FIG. 7, may be made of, for example, NOMEX covered neoprene available from Fall River Weaving, Inc., Fall River, Mass. The mounting member 35 of FIGS. 4 and 5, the mounting member 54 of FIG. 6, and the mounting member 64 of FIG. 7, may be made, for example, of NYLON available from DuPont and may be made by suitable stamping or die cutting. The tabs 38 and 39 of FIG. 4, may be made of NYLON available from DuPont and may be suitably injection molded.

It will be understood that many variations and modifications may be made in the present invention without departing from the spirit and the scope thereof.

What is claimed is:

1. Combination head and eye protective apparatus, comprising:

head-protective helmet including a headband including a forward portion mounted to said helmet and a rearward nape device for fitting said helmet to the head of a wearer of said helmet; and goggles including mounting means for mounting said goggles directly to said rearward nape device.

2. Combination head and eye protective apparatus, comprising:

head-protective helmet including an outer shell having an interior, an inner impact cap mounted removably to the interior of said outer shell, said inner impact cap having an interior, a head band mounted to the interior of said inner impact cap, said head band including a nape device for varying the size of said head band to fit said head band to the head of a wearer of said helmet; and goggles including mounting means for mounting said goggles to said nape device.

3. Combination head and eye protective apparatus, comprising:

a head-protective helmet including a crown having a forward portion and a brim extending at least forwardly of said crown, said helmet provided with a head band mounted generally internally of said crown and said head band including a rearward nape device including a rotatable ratchet knob for being rotated to vary the size of said head band to fit said head band to the head of a wearer of said helmet;

goggles including a frame having outer portions, eye protective lens mounted to said frame, elastic connecting means and a mounting member, said elastic connecting means connected to said outer portions of said frame and to said mounting member; and said mounting member having an opening formed therein through which opening said rotatable ratchet knob is inserted to mount said mounting member to said nape device and thereby to mount said goggles to said helmet, said elastic connecting means being sufficiently contractible to stow said frame and said lens against said forward portion of said crown when said goggles are not in use and said elastic connecting means being sufficiently stretchable to permit said frame and said lens to be pulled over said forward portion of said brim and placed over the eyes of a wearer of the helmet and said elastic connecting means being sufficiently contractible to hold said frame and said lens over the eyes of a wearer of the helmet.

4. The combination according to claim 3 wherein said head-protective helmet includes an outer shell having an interior, an inner impact cap having an interior and being mounted removably to the interior of said outer shell, and wherein said head band is mounted to the interior of said inner impact cap.

5. The combination according to claim 4 wherein said rotatable ratchet knob has an effective outer diameter and wherein said opening formed in said mounting member is generally circular and has a diameter slightly smaller than said effective outer diameter of said rotatable ratchet knob.

6. The combination according to claim 4 wherein said mounting member is flexible and is provided with at least one slot extending into said opening, said slot for enhancing the flexibility of said mounting member to facilitate insertion of said rotatable ratchet knob through said opening.

7. The combination according to claim 6 wherein said mounting member is provided with a pair of diametrically opposed slots extending into said opening for enhancing the flexibility of said mounting member.

8. The combination according to claim 4 wherein said nape device has a curvature which curves outwardly and wherein said mounting member is sufficiently flexible to permit said mounting member to generally conform to said curvature of said nape device.

9. The combination according to claim 4 wherein said elastic connecting means comprise a pair of elastic members having first and second ends, wherein said mounting member has outer portions, and wherein said first ends of said elastic members are connected to said outer portions of said frame and wherein said second ends of said elastic members are connected to said outer portions of said mounting member.

10. The combination according to claim 9 wherein said outer portions of said mounting member are provided with openings, wherein said second ends of said elastic members are provided with tabs including split button snaps which snap into said openings formed in said outer portions of said mounting member to mount said second ends of said elastic members pivotally to said mounting member.

11. The combination according to claim 4 wherein said elastic connecting means comprise an elastic member having opposed ends connected to said outer portions of said frame, and wherein said mounting member is provided with at least a second opening through which said elastic member extends to connect said elastic member to said mounting member.

12. The combination according to claim 11 wherein said mounting member is provided with a pair of additional openings through which said elastic member extends to connect said elastic member to said mounting member.

13. The combination accordingly to claim 12 wherein said mounting member is generally vertically extending and includes an upper portion and a lower portion, wherein said pair of additional openings through which said elastic member extends are formed in said upper portion and wherein said opening through which said rotatable ratchet knob is inserted is formed in said lower portion.

14. The combination according to claim 11 wherein said outer portions of said mounting member are provided with openings and wherein said second ends of said elastic members are formed into loops extending through said openings formed in said outer portions of said mounting member to mount said second ends of said elastic members to said mounting member.

15. The combination according to claim 11 wherein said mounting member is generally longitudinally extending.

16. Combination head and eye protective apparatus, comprising:

a protective helmet for being worn by a wearer to protect the wearer's head, said protective helmet provided with nape device for being secured to the nape of the wearer's head to fit said head-protective helmet to the wearer's head;

goggles for protecting the eyes of the wearer, said goggles having opposed ends;

a pair of straps having opposed ends, one end of each strap mounted to one end of said goggles and the other end of each strap mounted pivotally to said nape device to facilitate the pivoting of said goggles with respect to said nape securing means to facilitate the placement of said goggles in a donned position over the eyes of the wearer and in a stowed position on said helmet.

17. The combination according to claim 16 wherein said other end of each strap is provided with a tab mounted pivotally to said nape device by tab mounting means.

18. Goggles, comprising:

a goggle frame, eye protective lens mounted in said frame, elastic connecting means and a mounting member, said elastic connecting means interconnecting said goggle frame and said mounting means, and said mounting means provided with an opening for receiving the rotatable ratchet knob of a nape device to mount said goggles to a head-protective helmet including the nape device.

19. Goggles for being mounted to a head-protective helmet provided with a head band including a nape device including a rotatable ratchet knob for being rotated to vary the size of the head band, comprising:

a goggle frame, eye protective lens mounted in said frame, a mounting member, and elastic connecting means interconnecting said goggle frame and said mounting member, said mounting member provided with an opening for having the rotatable ratchet knob inserted therethrough to mount said mounting member to the nape device and to thereby mount said goggles to the head-protective helmet.

20. The goggles according to claim 19 wherein the rotatable ratchet knob has an effective outer diameter and wherein said opening formed in said mounting member is generally circular and has a diameter slightly smaller than the effective outer diameter of the rotatable ratchet knob.

21. The goggles according to claim 19 wherein said mounting member is flexible and is provided with at least one slot extending into said opening, said slot for enhancing the flexibility of said mounting member to facilitate insertion of said rotatable ratchet knob through said opening.

22. The goggles according to claim 21 wherein said mounting member is provided with a pair of diametrically opposed slots extending into said opening for enhancing the flexibility of said mounting member.

23. The goggles according to claim 22 wherein the nape device has a curvature which curves outwardly and wherein said mounting member is sufficiently flexible to permit said mounting member to generally conform to said curvature of said nape device.

24. The goggles according to claim 19 wherein said elastic connecting means comprise a pair of elastic members having first and second ends, wherein said mounting member has outer portions, and wherein said first ends of said elastic members are connected to said outer portions of said frame and wherein said second ends of said elastic members are connected to said outer portions of said mounting member.

25. The goggles according to claim 24 wherein said outer portions of said mounting member are provided with openings, wherein said second ends of said elastic members are provided with tabs including split button snaps which snap into said openings formed in said outer portions of said mounting member to mount said second ends of said elastic members pivotally to said mounting member.

26. The combination according to claim 19 wherein said elastic connecting means comprise an elastic member having strap ends connected to said outer portions of said frame, and wherein said mounting member is provided with at least a second opening through which said elastic member extends to connect said elastic member to said mounting member.

27. The goggles according to claim 26 wherein said mounting member is provided with a pair of additional openings through which said elastic member extends to connect said elastic member to said mounting member.

28. The goggles according to claim 10 wherein said mounting member is generally vertically extending and includes an upper portion and a lower portion and wherein said pair of additional openings through which said elastic member extends is formed in said upper portion and wherein said opening through which said rotatable ratchet knob is inserted is formed in said lower portion.

29. The goggles according to claim 24 wherein said outer portions of said mounting member are provided with openings and wherein said second ends of said elastic members are formed into loops extending through said openings formed in said outer portions of said mounting member to mount said second ends of said elastic members to said mounting member.

* * * * *